United States Patent [19]

Khoshkish

[11] Patent Number: 4,881,335

[45] Date of Patent: Nov. 21, 1989

[54] DOOR SIGN DEVICE

[76] Inventor: Kamran Khoshkish, 25081 Devon, Mission Viejo, Calif. 92691

[21] Appl. No.: 183,667

[22] Filed: Apr. 19, 1988

Related U.S. Application Data

[63] Continuation-in-part of Ser. No. 143,737, Jan. 13, 1988.

[51] Int. Cl.[4] ..... G09F 9/00

[52] U.S. Cl. ..... 40/449; 40/594; 40/459; 40/426; 116/204; 446/134

[58] Field of Search ..... 40/459, 460, 600, 621, 40/426, 538, 449, 446, 594; 116/204, 309; 33/DIG. 1; 446/134, 135, 136

[56] References Cited

U.S. PATENT DOCUMENTS

| | | | |
|---|---|---|---|
| 588,149 | 8/1897 | Hinckley | 40/460 |
| 1,410,853 | 3/1922 | Tollenaar | 40/459 |
| 1,947,920 | 2/1934 | Primrose | 446/134 |
| 3,253,295 | 5/1966 | Waters | 116/204 |
| 3,486,479 | 12/1969 | Hartmann | 116/204 |
| 3,670,435 | 6/1972 | Steward | 40/621 |
| 3,827,168 | 8/1974 | Mori | 40/621 |

FOREIGN PATENT DOCUMENTS

| | | | |
|---|---|---|---|
| 497373 | 3/1929 | Fed. Rep. of Germany | 40/600 |
| 9606 | 10/1889 | United Kingdom | 40/460 |
| 391314 | 4/1933 | United Kingdom | 40/460 |

*Primary Examiner*—Robert Peshock
*Assistant Examiner*—J. Hakomaki
*Attorney, Agent, or Firm*—Gordon L. Peterson; Loyal M. Hanson

[57] ABSTRACT

A door sign device includes an actuator mounted on the inner door surface of a door that has inner and outer door surfaces so that a user can move the actuator between first and second actuator positions, and a follower mounted on the outer door surface so that the follower can be move between first and second follower positions that each correspond to a respective one of the first and second actuator positions. Coupling components are included for coupling the actuator to the follower magnetically so that the follower follows actuator movement, and indicator components responsive to the follower being in the first follower position indicate that a predetermined sign applies. Roller-type actuator and follower components may be employed that are mounted for rotation about axes that are parallel to the inner and outer door surfaces.

4 Claims, 5 Drawing Sheets

DOOR SIGN DEVICE

CROSS-REFERENCE TO RELATED APPLICATION

This application is a continuation-in-part of applicant's U.S. patent application Ser. No. 143,737 filed Jan. 13,-1988.

BACKGROUND OF THE INVENTION

1. Technical Field

This invention relates generally to door mountable devices that can be operated from one side of a door to selectively display a message on the other side of the door, and it particularly concerns such a device that accomplishes this without electronic components or the need for a hole through the door.

2. Background Information

Signs are often used on or adjacent doors to hospital rooms, hotel and motel room, offices, and conference rooms to communicate such messages as "Do Not Disturb," "In Conference," "Maid Service," "Occupied," and the like. This is done in some cases with a door mountable device that can be operated from within the room on one side of the door to selectively display the sign outside the room on the other side of the door. The user does this without opening the door by operating some sort of actuator such as a knob or a sliding member.

However, existing devices for this purpose suffer from certain drawbacks that need to be overcome. They may, for example, employ relatively complicated and costly mechanical structure, require a hole through the door, and involve inconvenient installation and deinstallation procedures. Thus, it is desirable to have a new and improved device for this purpose—one that is less complicated and costly and more convenient to install and deinstall without the need for a hole through the door.

SUMMARY OF THE INVENTION

This invention solves the problems outlined above with magnetic coupling. A door sign device is provided that includes a sign-indicating follower assembly mounted on the outer door surface that the user moves to a selected position by adjusting the magnetically coupled actuator of an actuator assembly mounted on the inner door surface.

These components are easily fabricated. They are less complicated and less costly. They can be stuck onto the door for mounting ease, and they do not require a hole through the door.

Generally, a door sign device constructed according to the invention includes an actuator assembly and a follower assembly. The actuator assembly includes an actuator and first mounting means for mounting the actuator on the inner door surface of a door that has inner and outer door surfaces so that a user can move the actuator between first and second actuator positions. The follower assembly includes a follower and second mounting means for mounting the follower on the outer door surface so that the follower can be move between first and second follower positions that each correspond to a respective one of the first and second actuator positions.

According to a major aspect of the invention, the actuator and follower are magnetically coupled so that when the actuator is moved to the first actuator position the follower moves to the first follower position and when the actuator is moved to the second actuator position the follower moves to the second follower position. One or both of the actuator and follower may be magnetized for this purpose.

A predetermined sign is included on the follower assembly, and the follower is arranged to indicate that the sign applies when the follower is in the first follower position. In other words, moving the follower to the first follower position results in the sign being exposed or pointed to as an indication that the message on the sign now applies. Various sign-indicating arrangements may be employed for this purpose.

The above-mentioned and other objects and features of this invention and the manner of attaining them will become apparent, and the invention itself will be best understood, by reference to the following description of an embodiment of the invention taken in conjunction with the accompanying drawings.

DESCRIPTION OF THE PREFERRED EMBODIMENTS

Figure 1:
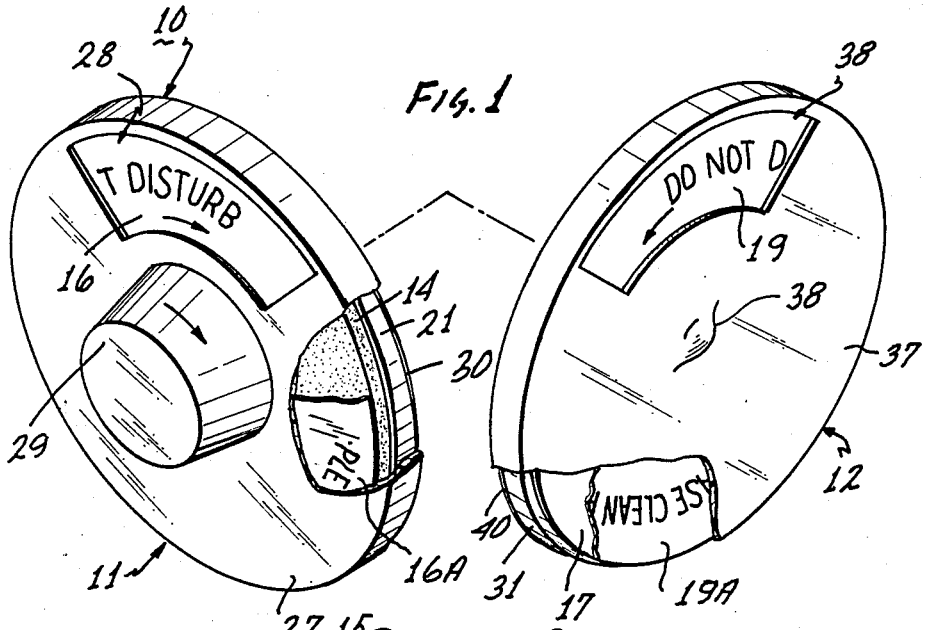
FIG. 1 of the drawings is a perspective view of the actuator and follower mechanisms of a door sign device constructed according to the invention.
Figure 2:
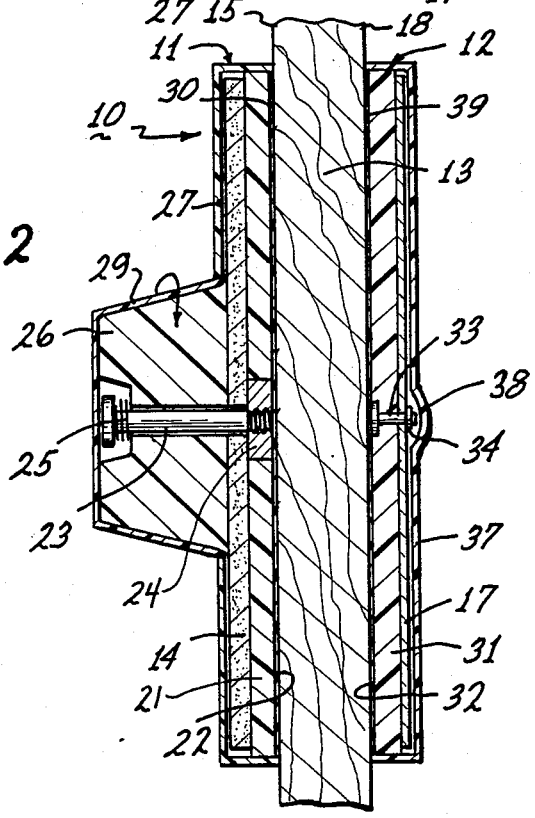
FIG. 2 is an elevation view taken in cross section of the actuator and follower assemblies mounted on a door.

Referring now to FIGS. 1 and 2, there is shown a door sign device 10 constructed according to the invention that includes an actuator assembly 11 and a follower assembly 12. These assemblies are arranged to be mounted opposite one another on generally parallel opposite sides of a door 13 as shown in FIG. 2 to enable a user on one side of the door 13 to communicate a message to a viewer on the other side of the door 13. For this purpose, the two assemblies are magnetically coupled so that by manipulating the actuator assembly 11, the user causes the follower assembly to move to a sign-indicating position.

The actuator assembly 11 includes a first magnetic disk or actuator 14 and first mounting means for mounting the disk 14 on an inner door surface 15 of the door 13 so that a user can move the actuator 14 between first and second actuator positions. The actuator 14 is illustrated in FIG. 1 being moved clockwise from the second actuator position to the first actuator position, the first position being a position where a sign 16 that reads "Do Not Disturb" is fully exposed and the second position being a position where the sign 16 is substantially unexposed.

The sign 16 is attached to the actuator 14 by suitable means, the illustrated embodiment utilizing adhesive attachment of a circular sheet of paper on which the sign is printed. The sign 16 is only partially exposed in FIG. 1 because the actuator is between the first and second actuator positions.

Similarly, the follower assembly 12 includes a second magnetic disk or follower 17 and second mounting means for mounting the follower on an outer door surface 18 of the door 13 so that the follower 17 can be move between first and second follower positions that each correspond to a respective one of the first and second actuator positions. The follower 17 is illustrated in FIG. 1 following movement of the actuator 14. Thus, it is moving counterclockwise from the second follower position to the first follower position. The first follower position is one where the sign 19 that reads "Do Not Disturb" is fully exposed and the second position being a position where the sign 19 is substantially unexposed. The sign 19 is attached to the follower 17 by suitable means, such as the sign attachment means used for the sign 16.

Thus, when the sign 16 is fully exposed, the sign 19 is also fully exposed. Similarly, when the sign 16 is not exposed, the sign 19 is not exposed either. This enables a user on one side of the door 13 to communicate a message to a viewer on the other side of the door 13 in the sense that the user can selectively expose the sign 19 to indicate that it applies.

Of course, additional signs may be used, such as the signs 16A and 19A (FIG. 1) that read "Please Clean Room." These signs may be located on the actuator and follower in positions such that they are exposed when the actuator and follower are in the second positions. Of course, they can be located so that they are exposed in third actuator and follower positions, with no sign being exposed in the second positions.

The first mounting means includes a first non-magnetic mounting member 21 that is dimensioned and arranged to be mounted on the inner door surface 15. The illustrated first mounting member 21 is composed of a thermoplastic material, for example, that can be adhesively attached to the inner door surface 15. As an idea of size, the illustrated assemblies 11 and 12 are approximately twelve centimeters in diameter and the first mounting member 21 is similarly sized. Of course, this dimension is not critical, and the assemblies can be larger or smaller depending on the application.

The first mounting member 21 has a first mounting surface 22 to be placed against the inner door surface 15, and the actuator 14 is rotatably mounted on the first mounting member 21 to enable rotation of the actuator 14 in a plane that is generally parallel to the first mounting surface 21. Thus, when mounted, the actuator 14 can rotate in a plane generally parallel to the inner door surface 15 (i.e., generally vertical for a vertically disposed door).

The actuator 14 is rotatably mounted on the first mounting member 21 by suitable means. For this purpose, the illustrated embodiment includes a screw member 23 that passes through the actuator 14 to a nut member 24. The nut member 24 is attached to the first mounting member 21 by suitable known means, such as a friction fit or bonding, and a spring 25 is utilized to retain a knob 26 in contact with the actuator 14.

A first inner cover member or inner cover 27 that defines a window 28 through which the sign 16 can be exposed (FIG. 1) is disposed over the actuator 14 as illustrated. It is nontransparent and preferably composed of a suitable non-magnetic material such as a thermoplastic material. It utilizes a snap fit to engage the first mounting member 21.

A second inner cover member or knob cover 29 is disposed over the knob 26 utilizing a snap fit to engage the knob 26. A user grasps the knob cover 29, and thereby the knob 26, to rotate the actuator 14.

The first mounting member 21 is mounted by suitable means on the inner door surface 15. For this purpose, the illustrated embodiment utilizes a first adhesive strip 30 of the conventional type having a protective backing strip (not shown) an adhesive, the protective backing strip being removed before application of the strip 30 to the door 13. However, other attachment means such as screws can be used where the resulting screw holes are not objectionable.

The second mounting means includes a second non-magnetic mounting member 31 that is dimensioned and arranged to be mounted on the outer door surface 18. This may also be composed of a thermoplastic material. The second mounting member 31 has a second mounting surface 32 to be placed against the outer door surface 18, and the follower 17 is rotatably mounted on the second mounting member 31 to enable rotation of the follower 17 in a lane that is generally parallel to the second mounting surface 31.

Thus, when mounted, the follower 17 can rotate in a plane generally parallel to the outer door surface 18, which is generally vertical for a vertically disposed door.

The follower 17 is rotatably mounted on the second mounting member 31 by suitable means. For this purpose, the illustrated embodiment includes a pin member 33 that passes through the follower 17. It is retained by a spring clip member 34. A nontransparent outer cover member or outer cover 37 that defines a window 38 through which the sign 19 can be exposed (FIG. 1) is disposed over the follower 17 as illustrated, utilizing a snap fit to engage the second mounting member 31. The outer cover 37 includes a dome 38 that provides clearance for the pin 33, and the second mounting member 31 is mounted by suitable means on the outer door surface 18, such as a second adhesive strip 40.

The invention includes coupling means for coupling the actuator 14 to the follower 17 magnetically so that when the actuator 14 is moved to the first actuator position the follower 17 moves to the first follower position and when the actuator 14 is moved to the second actuator position the follower 17 moves to the second follower position. This coupling means includes at least a portion of the actuator 14 that is magnetic and at least a portion of the follower 17 that is magnetic, at least one of those magnetic portions being magnetized.

This is done according to know means so that the follower 17 follows the actuator 14 as desired. Both the actuator 14 and the follower 17 may be magnetized metal disks, for example, or they may be thermoplastic disks in which a magnetic material is imbedded.

Of course, circular motion need not be employed within the broader concepts disclosed. Both the actuator and the follower can move linearly or rotationally, or one linearly and one rotationally. Preferably, both the actuator 14 and the follower 17 are arranged for rotational movement as illustrated, and the follower 17 is balanced so that it is easily rotated by the magnetic coupling in order to cause it to follow movement of the actuator 14. In addition, the actuator 14 and follower 17 are mounted directly across from one another to facilitate magnetic coupling.

As claimed, the invention also includes a predetermined sign located on the follower assembly, and sign-indicating means responsive to the follower being in the first follower position for indicating that the predetermined sign applies. The sign 19 serves as a predetermined sign, and the cover 37 functions as sign-indicating means, the follower 17 moving the sign 19 to an exposed position (the first follower position) to indicate that the sign 19 applies.

Figure 3:
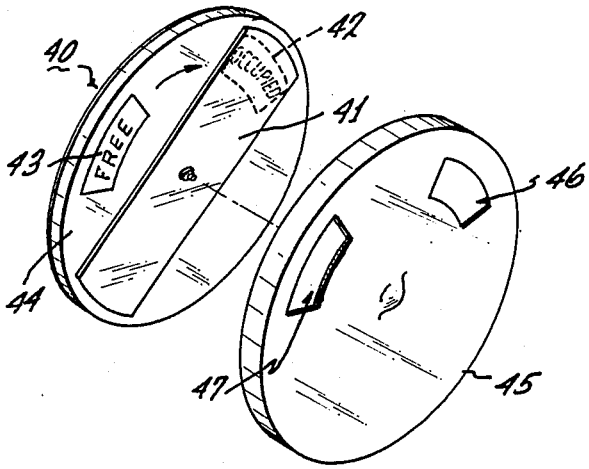
FIGS. 3–5 illustrate alternate sign-indicating arrangements.

Other sign-indicating arrangements may be employed. FIG. 3 illustrates a follower assembly 40 wherein the sign-indicating arrangement includes a follower 41 corresponding to the follower 17 in FIGS. 1 and 2. Two signs 42 and 43 are mounted on a mounting member 44 that corresponds to the second mounting member 31 in FIGS. 1 and 2, and the follower 41 is in the form of a bar magnet that follows an associated actuator (not shown) in moving between first and second follower positions.

The follower covers the sign 42 in the first follower position (illustrated) to expose the sign 43, and it covers the sign 43 in the second follower position (not illustrated) to expose the sign 42. In addition, a cover 45 is provided that defines two windows 46 and 47 that each aligned with a respective one of the signs 42 and 43.

Figure 4:
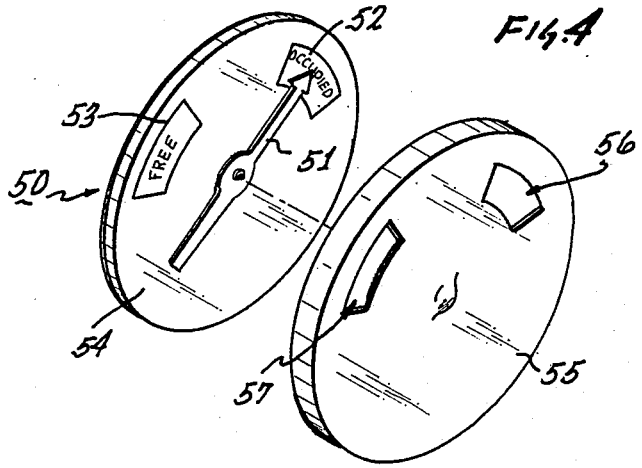

FIG. 4 illustrates another follower assembly 50 wherein the sign-indicating arrangement includes a follower 51 corresponding to the follower 17 in FIGS. 1 and 2. Two signs 52 and 53 are mounted on a mounting member 54 that corresponds to the second mounting member 31 in FIGS. 1 and 2, and the follower 41 is in the form of an arrow-shaped or compass needle like member that follows an associated actuator (not shown).

Thus, the follower 51 points to the sign 52 in the first follower position (illustrated) to indicate that he sign 52 applies, and it points to the sign 53 in the second follower position (not illustrated) to indicate that the sign 53 applies. Like the follower assembly 40, a cover 55 is provided to define two windows 56 and 57 that each aligned with a respective one of the signs 52 and 53.

Figure 5:
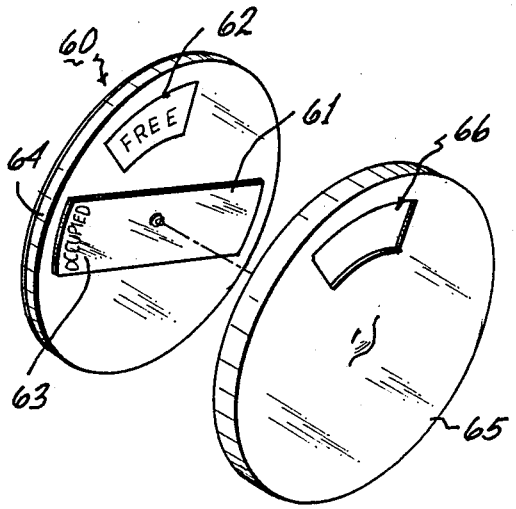

FIG. 5 illustrates yet another follower assembly 60 wherein the sign-indicating arrangement includes a bar magnet type of follower 61 that is somewhat like the follower 41 in FIG. 3. Two signs 62 and 63 are utilized, the sign 62 being mounted on a mounting member 64 that corresponds to the mounting member 44 in FIG. 3 and the sign 63 being mounted on the follower 61.

Thus, the follower 61 exposes the sign 62 in the second follower position (illustrated) to indicate that the sign 62 applies, and it covers the sign 62 while exposing the sign 63 in the first follower position (not illustrated) to indicate that the sign 63 applies. A cover 64 is provided that defines only one window 66 in this arrangement.

For each of the above follower assemblies, the actuator assembly can be generally similar to the follower assembly, the actuator assembly differing primarily in tat it includes some type of knob or other means by which the user can rotate the actuator. Also, the inner cover member or members is arranged to accommodate this difference.

Figure 8:
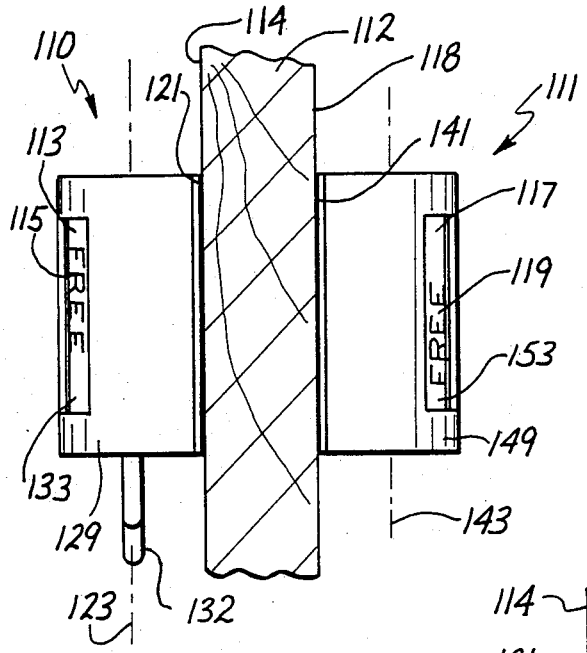
FIG. 8 is a top view of the roller-type actuator and follower assemblies mounted on a door.
Figure 9:
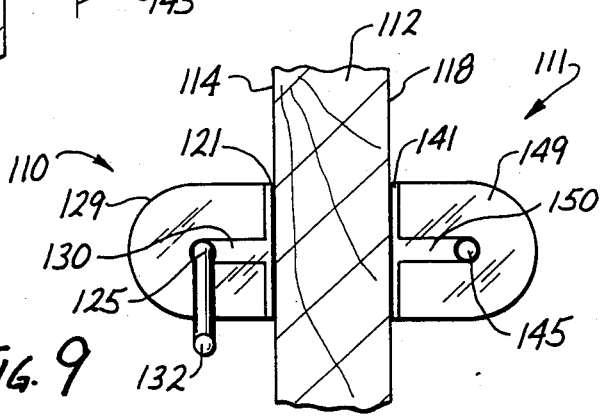
FIG. 9 is a side view of the roller-type assemblies mounted on the door.

Considering now the embodiment illustrated in FIGS. 6–11, it features a roller-type door sign device that includes a roller type actuator assembly 110 (FIGS. 6, 8, and 9) and a roller-type follower assembly 111 (FIGS. 7–10). Like the assemblies 28 and 38 described above, these assemblies are arranged to be mounted opposite one another on generally opposite sides of a door 112 as shown in FIGS. 8 and 9, and they are magnetically coupled so that by manipulating the actuator assembly 110, the user causes the follower assembly 111 to move to a sign indicating position. However, they so this with rotatable components that rotate about axes generally parallel to the door surface.

Figure 6:
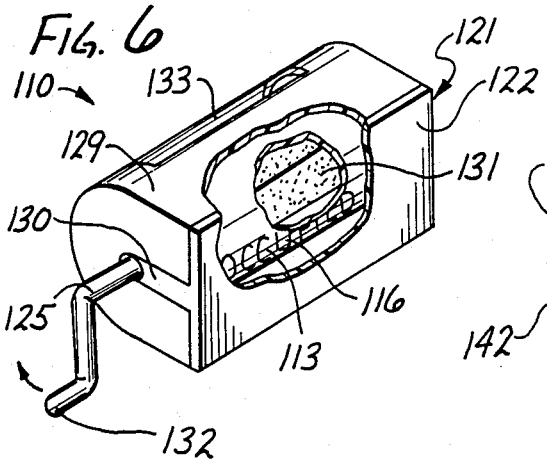
FIG. 6 is a perspective view of a roller-type actuator assembly constructed according to the invention.
Figure 7:
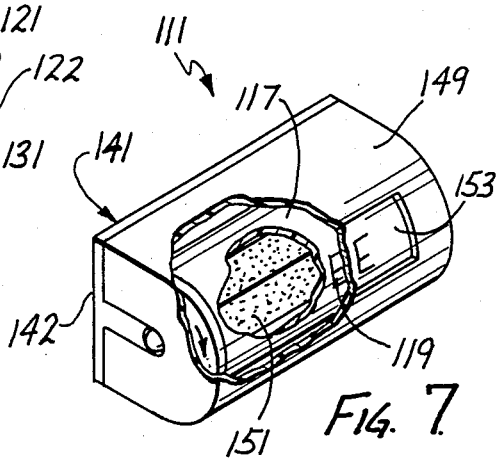
FIG. 7 is a perspective view of a roller-type follower assembly to be used with the roller-type actuator assembly.

The actuator assembly 110 includes an actuator 113 (FIG. 6) and first mounting means for mounting the actuator 113 on an inner door surface 114 of the door 112 (FIG. 7) so that a user can rotate the actuator 113 between first and second actuator positions. The actuator 113 is illustrated in FIG. 6 being moved clockwise from the second actuator position to the first actuator position. The first position is one is which a first actuator sign 115 that reads "FREE" (partially visible in FIGS. 8, 10, and 11) is exposed, while a second actuator sign 116 that reads "OCCUPIED" (partially visible in FIGS. 6, 10 and 11) is substantially unexposed. The second position is one in which the signs 115 and 116 are reversed in position so that the sign 116 is exposed and the sign 115 is substantially unexposed. Other signs can be used, such as "VACANT" instead of "FREE," for example.

Figure 12:
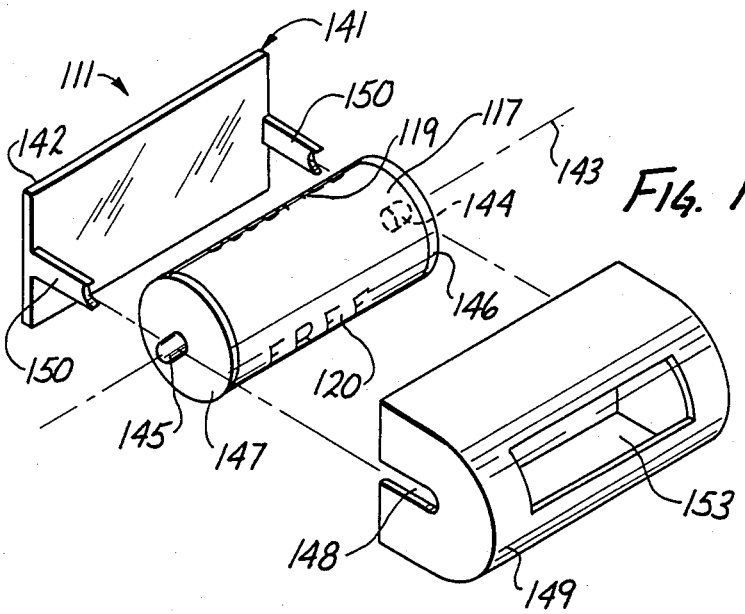
FIG. 12 is an exploded view of the roller-type follower assembly.

Similarly, the follower assembly 111 includes a follower 117 and second mounting means for mounting the follower on an outer door surface 118 of the door 112 so that the follower 116 can be move between first and second follower positions that each correspond to a respective one of the first and second actuator positions. The follower 117 is illustrated in FIG. 6 following movement of the actuator 113. It is shown moving clockwise (although it could just as well move counterclockwise) from the second follower position in which a second follower sign 119 ("OCCUPIED," partially visible in FIGS. 12 and 13) is exposed, to the first follower position in which a first follower sign 120 that says "FREE" (partially visible in FIGS. 7, 8, 12, and 13) is exposed.

Thus, when the sign 115 is fully exposed, the sign 120 is also fully exposed. Similarly, when the sign 115 is not exposed, the sign 120 is not exposed either.

The first mounting means includes a first non-magnetic mounting member 121 that is dimensioned and arranged to be mounted on the inner door surface 114. The illustrated first mounting member 121 is composed of a thermoplastic material, for example, that can be adhesively attached to the inner door surface 114, and it has a first mounting surface 122 to be placed against the inner door surface 114.

The actuator 113 is rotatably mounted on the first mounting member 121 to enable rotation of the actuator 113 about an actuator axis 123 (FIGS. 8, 10 and 11) that is generally parallel to the first mounting surface 122. Thus, when mounted, the actuator 113 can rotate about an axis that is generally parallel to the inner door surface 114, preferably horizontal for a vertically disposed door.

Figure 10:
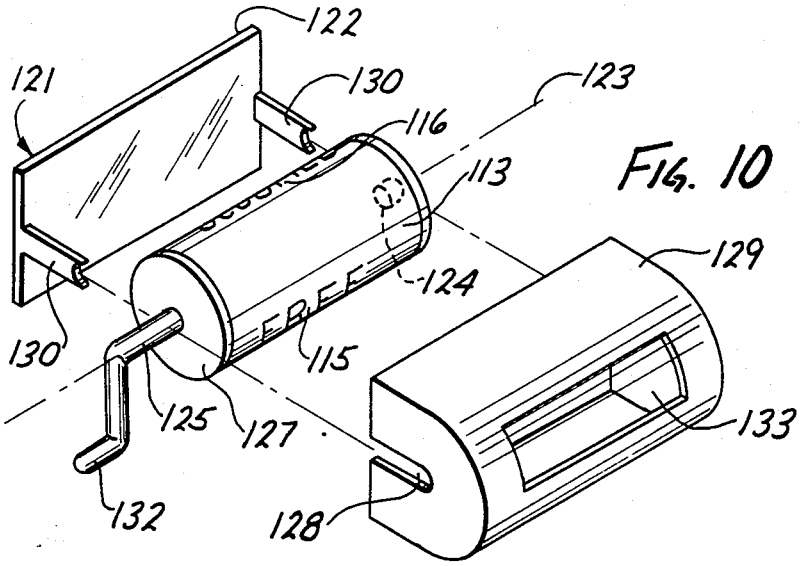
FIG. 10 is an exploded view of the roller-type actuator assembly.

The actuator 113 is rotatably mounted on the first mounting member 121 by suitable means. For this purpose, the actuator 113 includes first and second shafts 124 and 125 (FIGS. 10 and 11) on caps 126 and 127 that attached to opposite ends of the actuator 113 by suitable means, such as an interference fit. Then, the shafts 124 and 125 are retained within oppositely disposed grooves 128 (only one visible in FIG. 10) in a cover member 129 by tabs 130 on the mounting member 121. The tabs 130 also attach (to the cover member 129) by suitable means, such as an interference fit within the grooves 128 (FIG. 10).

Figure 11:
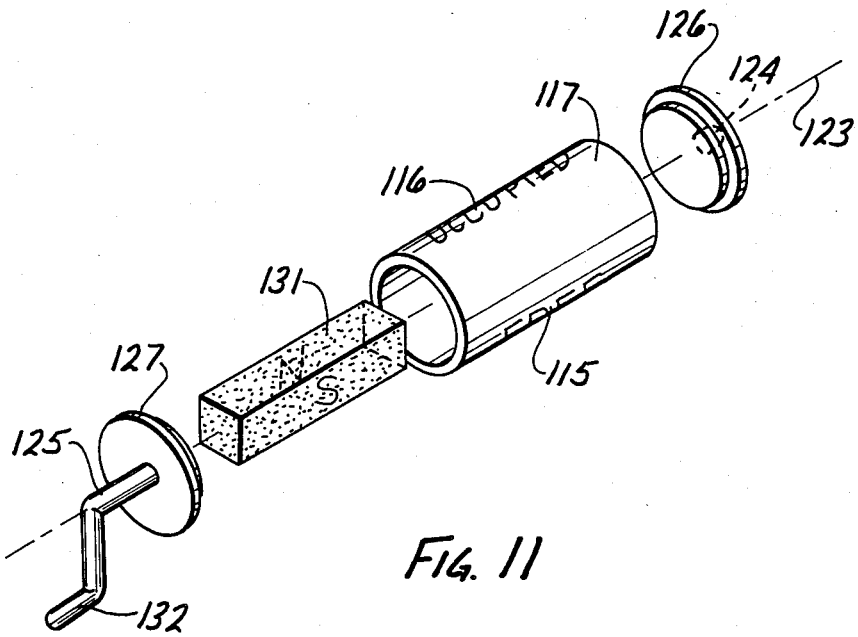
FIG. 11 is an exploded view of the roller-type actuator.

Before the actuator 113 is mounted in this way, a magnetic 131 is mounted within the actuator 113. It is mounted as illustrated in FIG. 11 so that it extends along the actuator axis 123 with the north and south magnetic poles disposed radially opposite each other. One of the north and south poles is disposed toward the sign 115, and the other one is disposed toward the sign 116.

In this regard, the magnetic 131 may be any of various magnetic materials providing this north and south pole alignment that is suitably sized and shaped to be retained in the actuator 113 (by suitable know means) and statically balanced about the actuator axis 123. The actuator 113 remains stationery, therefore, until rotated by the user operating a crank portion 132 of the second axle 125. This is done to move one of the signs 115 and 116 to a position such that it is exposed in a window 133 defined by the cover member 128, and this results in the follower moving to a corresponding position to expose a corresponding one of the signs 119 and 120.

The follower 117 is similarly constructed, except that the north and south poles of the magnet are oppositely disposed relative to the "FREE" and "OCCUPIED" signs and a crank portion is omitted.

Thus, the second mounting means includes a second non-magnetic mounting member 141 that is dimensioned and arranged to be mounted on the outer door surface 118. Like the first mounting member 121, it may be composed of a thermoplastic material that can be adhesively attached to the outer door surface 118, and it has a second mounting surface 142 to be placed against the outer door surface 118.

The follower 117 is rotatably mounted on the second mounting member 141 to enable rotation of the follower 117 about a follower axis 143 (FIGS. 8, 12, and 13) that is generally parallel to the second mounting surface 142. Thus, when mounted, the follower 117 can rotate about an axis that is generally parallel to the outer door surface 118 and, preferably, horizontal for a vertically disposed door.

The follower 117 is rotatably mounted on the first mounting member 141 by suitable means. Like the actuator 113, the follower 117 includes first and second shafts 144 and 145 (FIGS. 12 and 13) on caps 146 and 147 that attached to opposite ends of the follower 117 like the caps 126 and 127 on the actuator 113. Then, the shafts 144 and 145 are retained within oppositely disposed grooves 148 (only one visible in FIG. 12) in a cover member 149 by tabs 150 on the mounting member 141 that attach to the cover member 149 by suitable means, such as an interference fit.

Figure 13:
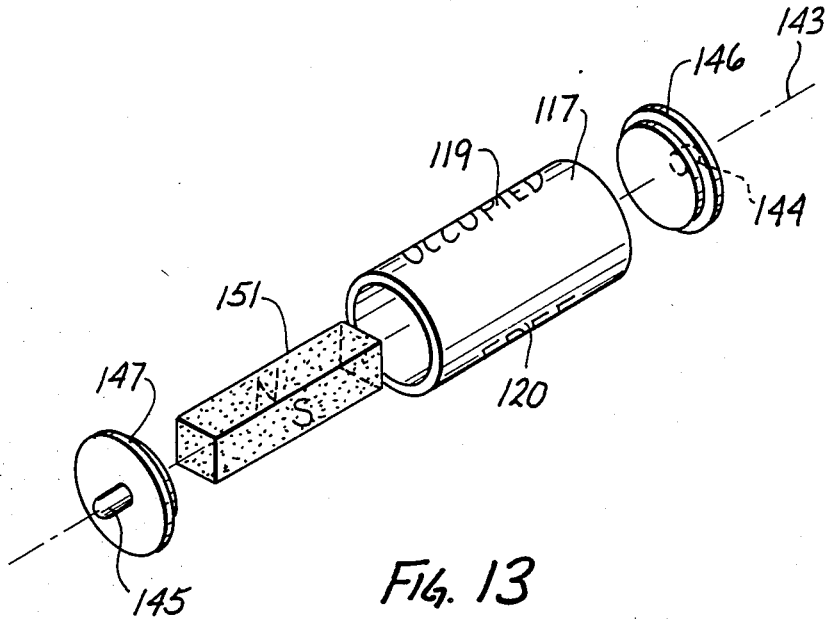
FIG. 13 is an exploded view of the roller-type follower.

Before the follower 117 is mounted in this way, a magnetic 151 is mounted within the follower 117. It is mounted as illustrated in FIG. 13 so that it extends along the actuator axis 143 with the north and south magnetic poles disposed radially opposite each other. One of the north and south poles is disposed toward the sign 115, and the other one is disposed toward the sign 116, opposite to the orientation used in the actuator 113.

Like the magnetic 131 in the actuator 113, the magnet 151 may be any of various magnetic materials providing this north and south pole alignment that is suitably sized and shaped to be retained in the follower 117 and statically balanced about the follower axis 143. The follower 117 remains stationery, therefore, until the actuator 113 moves. Then, the follower 117 moves to under influence of the magnetic forces. This is done to move one of the signs 119 and 120 to a position such that it is exposed in a window 153 defined by the cover member 148, corresponding the one of the signs 115 and 116 that is exposed in the window 133.

Thus, this invention utilizes magnetic coupling to overcome problems of the prior art. The components are easily fabricated. They are less complicated and less costly. They can be stuck onto the door for mounting ease, and they do not require a hole through the door.

As various changes may be made in the form, construction, and arrangement of the described components without departing from the spirit and scope of the invention and without sacrificing any of its advantages, all matter herein is to be interpreted as illustrative and not in any limiting sense.

What is claimed is:

1. A door sign device for mounting on a door having an inner door surface and an outer door surface, comprising:

an actuator assembly mounted on the inner door surface, the actuator assembly including an actuator and first mounting means for mounting the actuator on the inner door surface of the door so that a user can move the actuator between first and second actuator positions;

a follower assembly mounted on the outer door surface, the follower assembly including a follower and second mounting means for mounting the follower on the outer door surface so that the follower can be moved between first and second follower positions that each correspond to a respective one of the first and second actuator positions;

coupling means for coupling the actuator to the follower magnetically so that when the actuator is moved to the first actuator position the follower moves to the first follower position and when the actuator is moved to the second actuator position the follower moves to the second follower position;

a predetermined sign located on the follower assembly; and sign-indicating means responsive to the follower being in the first follower position for indicating that the predetermined sign applies;

wherein the first mounting means includes a first mounting member that is dimensioned and arranged to be mounted on the inner door surface, the first mounting member having a first mounting surface to be placed against the inner door surface, and the actuator is rotatably mounted on the first mounting member to enable rotation of the actuator between the first and second actuator positions about an actuator axis of rotation that is generally parallel to the first mounting surface; and wherein the second mounting means includes a second mounting member that is dimensioned and arranged to be mounted on the outer door surface, the second mounting member having a second mounting surface to be placed against the outer door surface, and the follower is rotatably mounted on the second mounting member to enable rotation of the follower between the first and second follower positions about a follower axis of rotation that is generally parallel to the second mounting surface.

2. A device as recited in claim 1, wherein the coupling means includes:

a magnetized portion of the actuator having north and south magnetic poles disposed radially opposite each other relative to the actuator axis of rotation; and a magnetized portion of the follower having north and south magnetic poles disposed radially opposite each other relative to the follower axis of rotation.

3. A device as recited in claim 1, wherein:

the sign is on the follower; and the sign-indicating means includes an outer cover member disposed over the follower, which outer cover member defines a window in a position such that the sign is visible through the window when the follower is in the first follower position and not visible through the window when the follower is in the second follower position.

4. A device as recited in claim 1, wherein:

the coupling means includes a magnetic portion of the actuator and a magnetic portion of the follower, at least one of which magnetic portions is magnetized.

* * * * *